US005927955A

United States Patent [19]

Janesky

[11] Patent Number: 5,927,955

[45] Date of Patent: Jul. 27, 1999

[54] SUMP PUMP CONTAINER AND METHOD

[76] Inventor: Lawrence M. Janesky, 11 Fawn Meadow La., Huntington, Conn. 06484

[21] Appl. No.: 08/708,147

[22] Filed: Jul. 11, 1996

[51] Int. Cl.[6] ..... F04B 35/04

[52] U.S. Cl. ..... 417/423.3; 222/383.2; 222/321.7

[58] Field of Search ..... 417/360, 423.3; 222/383.2, 321.7

[56] References Cited

U.S. PATENT DOCUMENTS 5,249,930 10/1993 Pacquesi ..... 417/313

5,529,462 6/1996 Hawes ..... 417/360

*Primary Examiner*—Charles G. Freay

*Attorney, Agent, or Firm*—Perman & Green, LLP

[57] ABSTRACT

A sump pump liner or container for a sump pump assembly designed to be automatically activated when the water level within the container, as sensed by an extended float, reaches a predetermined height. The invention resides in means, within the container, for preventing the pump assembly from moving close enough to the container wall to allow contact of the extended float with the wall. The floor of the container is provided with an integral stop member or a stop member insert to prevent movement of the sump pump assembly into contact with the container wall.

11 Claims, 2 Drawing Sheets

SUMP PUMP CONTAINER AND METHOD

BACKGROUND OF THE INVENTION

1. Field of the Invention

This invention relates to improved sump pump containers or sump liners which are sub-floor reservoirs for the reception of ground water which seeps into basements or other subterranean rooms. Generally the water is channeled to the sump reservoir and then pumped therefrom via a discharge conduit to an exterior location.

2. Description of the State of the Art

The present sump pump containers or sump liners are designed for use in water control systems of the types disclosed in my prior U.S. Pat. Nos. 5,314,313 and 5,501,044, for example. In such systems, the sump pump container is a reservoir for the reception of the water seepage which is channeled thereto, and the conventional sump pump contained therewithin includes a water-level actuated lever arm switch which energizes the pump to discharge the water from the container whenever the water level reaches a predetermined height, as sensed by a float attached to the lever arm.

A major problem arises from the fact that the size of the sump pump incorporated within the sump liner container will vary depending upon the requirements of different installations. Also, the sump pump tends to move or creep over the inner floor of the container during operation, and/or might be installed too close to the container wall, whereby its lever arm and float can engage the wall of the container and become inoperative. In such cases the container fills and overflows into the basement before the occupant becomes aware that a problem exists, unless the system is provided with a water level-sensing alarm as disclosed in my U.S. Pat. No. 5,314,313.

SUMMARY OF THE INVENTION

The present invention relates to a method and sump pump container for overcoming or avoiding the aforementioned problems by confining the creepage or vibrational movement of the pump to a central area of the inside floor of the container, thereby preventing the pump from approaching the container wall at a distance equal to or less than the extent of the maximum projection of the lever arm or float beyond the sump pump during operation of the lever arm and float.

According to an embodiment of the present invention, the sump pump container is molded from durable plastic composition in the shape of a barrel having an interior circular floor, and the floor is provided with an integral circular flange which is concentric with the cylindrical wall of the container but has a radius, from the center of the floor, which is less than the radius of the cylindrical wall by a distance which is greater than the length of maximum projection of the lever arm or float beyond the outer diameter surface of the flange when the sump pump abuts against the inner diameter surface of the flange.

According to a second embodiment of the present invention, the sump pump container is of conventional type having a flat interior floor, and a non-buoyant annular floor insert is provided in the shape of a donut having an outer wall radius slightly less then the radius of the cylindrical wall, adjacent the floor of the container, and having a circular central opening having an inner radius which is large enough to receive a sump pump of the desired size or capacity, the difference between the outer and inner radii being greater than the extent of maximum projection of the lever arm or float beyond the side of the sump pump when the pump abuts the wall of the opening.

THE DRAWINGS

Figure 1:
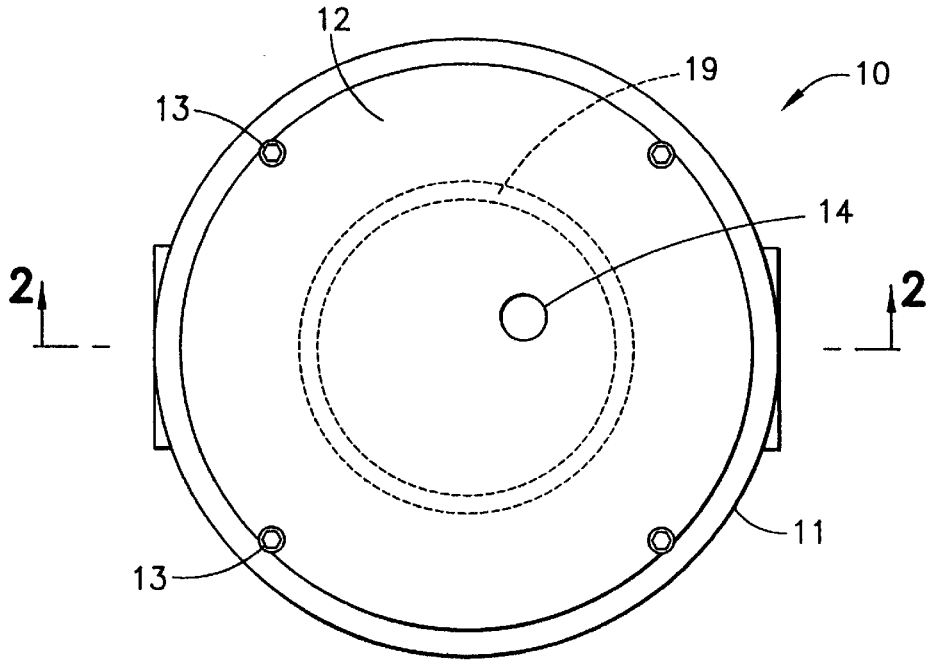
FIG. 1 is a plan view of a sump pump container according to one embodiment of the present invention.
Figure 2:
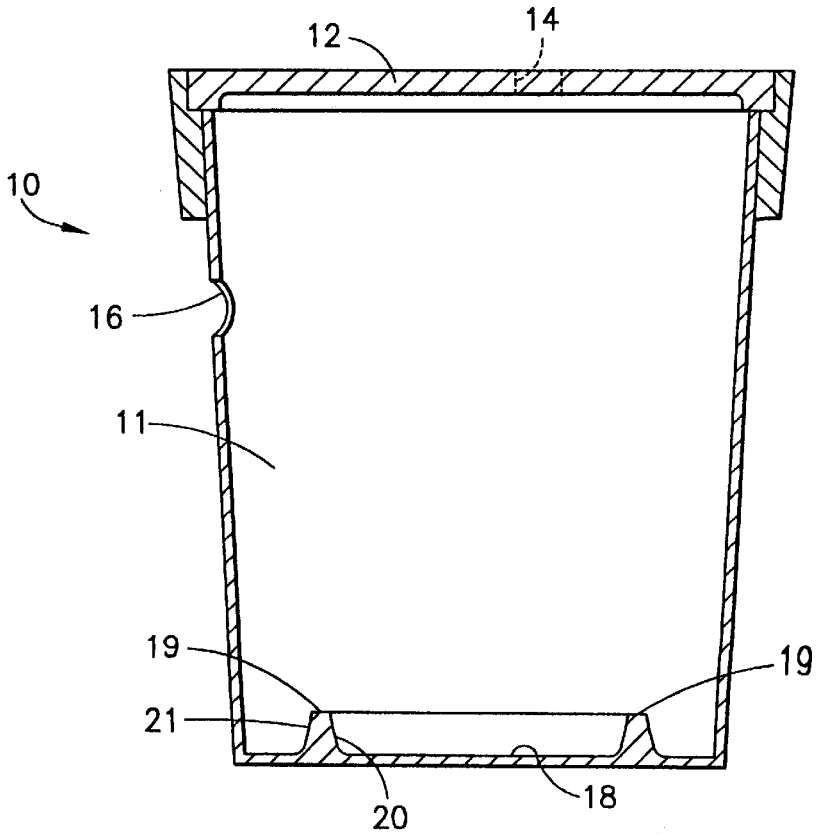
FIG. 2 is a view in partial cross-section taken along the line 2—2 of FIG. 1.
Figure 3:
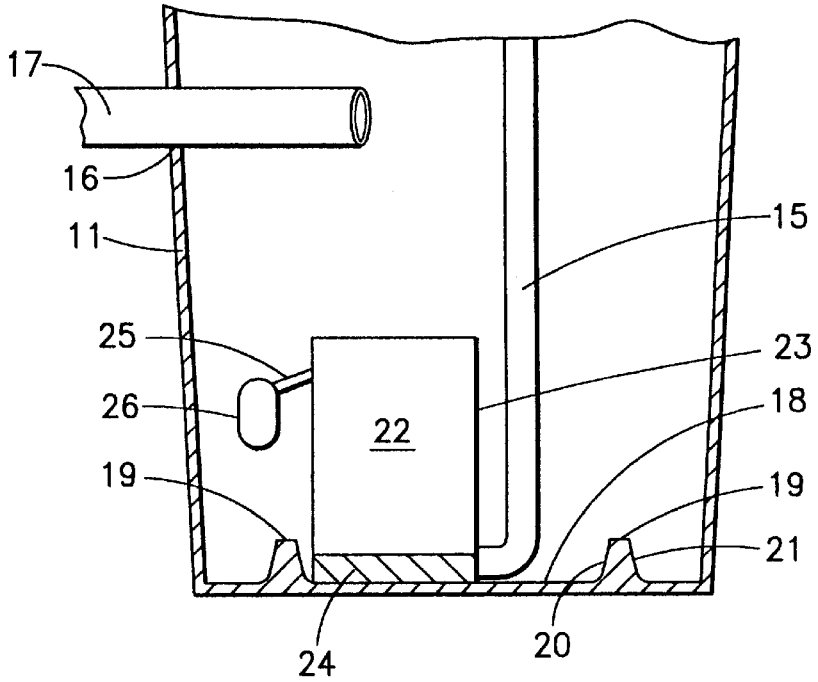
Figure 4:
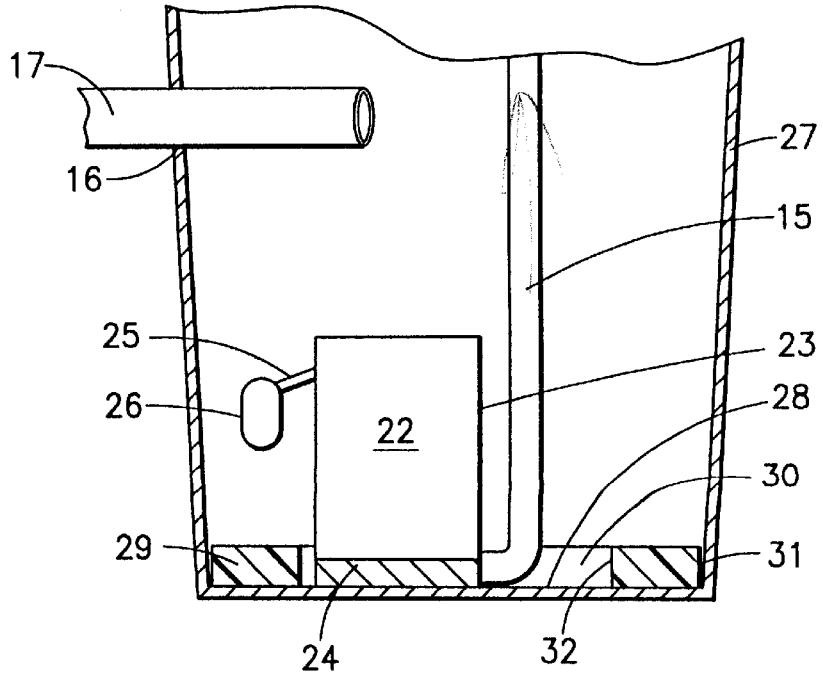

FIG. 3 is a sectional side view of the container of FIGS. 1 and 2 illustrating a sump pump confined therewithin at its position of maximum proximity to the interior container wall, and FIG. 4 is a sectional side view of a sump pump container according to another embodiment of the present invention, also illustrating a sump pump confined therewithin, at its position of maximum proximity to the interior container wall.

DETAILED DESCRIPTION

Referring to FIGS. 1 and 2 of the drawings, the sump pump container 10 comprises a barrel-shaped container body 11 and a cover 12 which is removably attached to the body 11 by a plurality of bolts 13 to enclose a sump pump therewithin. The cover 12 is provided with one or more openings 14 to accommodate the discharge conduit 15 from the sump pump (shown in FIGS. 3 and 4) and to admit a wire for electrification of the sump pump. The container body 11 is provided at an upper area of the sidewall with an opening 16 to admit a water inlet conduit 17, shown in FIGS. 3 and 4, through which the water control system discharge is introduced to the sump container 10 for pumping to an exterior location.

The container 10 or sump liner is designed to be installed beneath the floor of a basement to provide a lined sump to which excess water seepage is channeled through a water inlet conduit 17 for discharge out through a pump outlet conduit 15. The cover 12 of the installed container 10 is designed to be level with the floor of the basement, and removable to provide access to the pump assembly 22.

As illustrated mostly clearly in FIG. 3 with respect to the embodiment of FIGS. 1–3, the floor 18 of the container 10 is molded with an integral interior flange 19 in the form of a strong circular wall or stop member having an inner wall surface 20 and an outer wall surface 21. The inner diameter of the flange 19 is large enough to accommodate a sump pump assembly 22 of the desired size or displacement capacity. The sump pump assembly 22 comprises a cylindrical housing 23 having a water-inlet base 24, a lever arm 25 comprising a pump-actuation switch, and a buoyant float 26 which raises the lever arm 25 to actuate the pump 22 when the water level within the container 10 rises to a predetermined depth. Actuation of the pump 22 discharges water from the container 10, through the conduit 15, to an exterior location.

As illustrated by FIG. 3, while the pump assembly 22 is free to move over the floor 18, due to vibration and submersion in water, the inside surface 20 of the annular wall 19 limits the maximum proximity to the inside wall of the container body 11 to a distance which is greater than the maximum length of extension of the lever arm 25 and float 26 beyond the pump housing 23 during actuation. This prevents the float from contacting and becoming pressed against the inside wall of the container body 11 to render the pump inoperative, as can occur with conventional sump pump containers or liners.

FIG. 4 illustrates a related embodiment of the present invention for producing the same results as the embodiment of FIG. 3 while using a conventional barrel-shaped container body 27 having a relatively smooth inside floor 28. This is accomplished by producing and inserting a non-buoyant annular floor member 29 or donut having a circular central opening 30 of sufficient diameter to accommodate a sump pump 22 of the desired size and displacement capacity.

The circular floor member 29 has an outer wall surface 31 having a radius slightly less than the radius of the circular floor 28, and an inner wall surface 32. The difference between the outer radius and the inner radius is a distance greater than the extent of extension of the lever arm 25 and float 26 beyond the pump housing 23 during actuation of the pump assembly 22, to prevent any binding between the float 26 and the inside wall of the container body 27 when the assembly 22 is at its closest proximity to the container wall, abutting the inner surface 32 of the insert 29.

The floor member must be non-buoyant and should be corrosion-resistant. A suitable construction is a solid high density molded resinous composition, or a hollow plastic body filled with sand or other filler material.

It will be apparent to those skilled in the art, in light of the present disclosure that a variety of different means can be used to accomplish the objects of the present invention without unduly restricting the size and capacity of sump pump assemblies which can be used, and while permitting some degree of positioning and movement of the pump assembly, such as to permit alignment of the discharge conduit 15 with an exit hole 14 in the container cover 12, shown in FIG. 1.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A sump pump liner or container adapted to contain a sump pump assembly having a housing and a lever arm and buoyant float which extend radially outwardly of said housing to actuate the pump whenever the water level within said container rises to a predetermined level, characterized by the sump pump liner having an interior pump-supporting floor comprising a raised annular stop means comprising a wall means extending upwardly from said floor for loosely centering the sump pump assembly with its housing supported in contact with said floor, at the bottom of the container, for preventing movement of the pump housing on said floor sufficiently close to the interior wall of the liner or container to permit contact between said wall and extended lever arm or float.

2. A sump pump liner or container according to claim 1 in which said raised annular stop means consists of a raised integral continuous flange which is concentric with the floor of the liner or container but has a smaller radius.

3. A sump pump liner or container according to claim 2 comprising a molded plastic liner or container having an integrally molded plastic annular flange.

4. A sump pump liner or container according to claim 1 in which said raised annular stop means comprises an insert.

5. A sump pump liner or container according to claim 4 in which said insert comprises a donut-shaped insert having an outer wall radius slightly smaller than the radius of the interior floor of the liner or container, and having an inner wall having a central opening diameter which is larger than the diameter of the sump pump housing to be contained therewithin and supported on the floor of the liner or container.

6. A sump pump liner or container according to claim 1 further comprising a removable cover means.

7. A method for preventing a sump pump assembly comprising a housing and a lever arm and float which extend radially-outwardly of said housing within a liner or container from malfunctioning due to movement of the assembly into contact with the interior wall of the liner or container, which comprises providing the interior floor of the liner or container with a raised annular stop means comprising a wall means extending upwardly from said floor for loosely centering the sump pump assembly with its housing supported in contact with said floor, at the bottom of the container, to prevent movement of the pump housing on said floor sufficiently close to the interior wall of the liner or container to permit contact between the wall and the extended liner arm or float.

8. The method according to claim 7 comprising providing the interior floor with a raised integral continuous flange which is concentric with the floor of the liner or container to form said annular stop means.

9. The method according to claim 8 comprising molding said liner or container from plastic molding composition with an integral molded plastic annular flange as said raised stop means.

10. The method according to claim 7 which comprises forming said raised annular stop means as a non-buoyant element separate from said liner or container, and inserting said stop means against the interior floor of the liner or container.

11. The method according to claim 10 comprising forming said stop means as a donut-shaped raised annular insert having an outer wall radius slightly smaller than the radius of the interior floor of the liner or container, and having an inner wall having a central opening diameter larger than the diameter of the sump pump housing to receive and support the sump pump housing on the floor of the liner or container.

* * * * *

UNITED STATES PATENT AND TRADEMARK OFFICE

CERTIFICATE OF CORRECTION

PATENT NO. : 5,927,955

DATED : 7/27/99

INVENTOR(S) : Lawrence M. Janesky

It is certified that error appears in the above-identified patent and that said Letters Patent is hereby corrected as shown below:

IN THE CLAIMS:

In Column 4, line 39 before the word "plastic" insert --continuous--.

In Column 4, line 50 after the word "having" delete --an--. (Claim 11)

Signed and Sealed this

Twenty-ninth Day of February, 2000

*Attest:*

Q. TODD DICKINSON

*Attesting Officer*

*Commissioner of Patents and Trademarks*